US005641282A

United States Patent [19]

Lee et al.

[11] Patent Number: 5,641,282

[45] Date of Patent: Jun. 24, 1997

[54] ADVANCED RADIANT GAS BURNER AND METHOD UTILIZING FLAME SUPPORT ROD STRUCTURE

[75] Inventors: K. J. Lee, Lawrenceville; Joe K. Cochran, Jr., Marietta; Tzyy-Jiuan Hwang, Alpharetta, all of Ga.

[73] Assignee: Gas Research Institute, Chicago, Ill.

[21] Appl. No.: 395,823

[22] Filed: Feb. 28, 1995

[51] Int. Cl.[6] ..... F23D 3/40; F23D 14/14

[52] U.S. Cl. ..... 431/7; 431/328; 431/347; 431/346; 126/92 AC; 126/91 A

[58] Field of Search ..... 431/7, 326, 170, 431/328, 329, 327, 346, 347; 126/92 AC, 91 A, 91 R, 41 R

[56] References Cited

U.S. PATENT DOCUMENTS

| | | | |
|---|---|---|---|
| 3,556,707 | 1/1971 | Hine, Jr. | 431/328 |
| 3,561,902 | 2/1971 | Best | 431/328 |
| 3,639,095 | 2/1972 | Zink et al. | 431/177 |
| 3,667,449 | 6/1972 | Persinger et al. | 126/41 R |
| 3,683,058 | 8/1972 | Partiot | 264/156 |
| 3,726,633 | 4/1973 | Vasilakis et al. | 431/329 |
| 3,751,213 | 8/1973 | Sowards | 431/328 |
| 3,881,858 | 5/1975 | Fitzgerald | 431/348 |
| 3,912,443 | 10/1975 | Ravault et al. | 431/328 |
| 3,934,811 | 1/1976 | Perl | 251/11 |
| 3,954,387 | 5/1976 | Cooper | 431/328 |
| 3,968,785 | 7/1976 | Perl | 126/39 J |
| 3,989,028 | 11/1976 | Berger | 126/41 R |
| 4,034,206 | 7/1977 | Penrod | 219/464 |
| 4,220,132 | 9/1980 | Streisel | 126/271 |
| 4,248,586 | 2/1981 | Cooper | 431/328 |
| 4,321,857 | 3/1982 | Best | 99/340 |
| 4,353,532 | 10/1982 | Jay | 266/242 |
| 4,432,791 | 2/1984 | Jayaraman et al. | 75/65 R |
| 4,543,940 | 10/1985 | Krill et al. | 126/92 |
| 4,569,328 | 2/1986 | Shukla et al. | 126/39 J |
| 4,599,066 | 7/1986 | Granberg | 431/329 |
| 4,604,054 | 8/1986 | Smith | 431/328 |
| 4,721,456 | 1/1988 | Granberg et al. | 431/328 |
| 4,724,823 | 2/1988 | Simpson | 126/39 R |
| 4,799,879 | 1/1989 | Laspeyres | 431/328 |
| 4,850,334 | 7/1989 | Cassagne et al. | 126/91 R |
| 4,856,492 | 8/1989 | Kawamoto | 126/91 A |
| 4,878,837 | 11/1989 | Otto | 431/328 |
| 4,883,423 | 11/1989 | Holowczenko | 431/328 |
| 4,889,481 | 12/1989 | Morris et al. | 431/328 |
| 4,900,245 | 2/1990 | Ahmady | 431/328 |
| 4,951,648 | 8/1990 | Shukla et al. | 126/21 A |
| 4,977,111 | 12/1990 | Tong et al. | 501/95 |
| 5,024,209 | 6/1991 | Schaupert | 126/39 H |
| 5,062,408 | 11/1991 | Smith et al. | 126/41 R |
| 5,090,898 | 2/1992 | Smith | 431/326 |
| 5,235,667 | 8/1993 | Canfield et al. | 392/307 |
| 5,249,953 | 10/1993 | Roth | 431/7 |

*Primary Examiner*—Larry Jones

*Attorney, Agent, or Firm*—Thomas, Kayden, Horstemeyer & Risley

[57] ABSTRACT

A high intensity and high efficiency radiant gas burner (10) has a housing (8), a gas inlet (11) for receiving a combustible gas, a gas injection plate (13) for distributing the gas, a gas distribution chamber (16) for permitting the gas to expand, a porous ceramic layer (17) for receiving the gas from the gas distribution chamber (16), and a plurality of elongated flame support rods (23) situated over and spaced from a burner surface (**17*b*) of the porous ceramic layer (17). When the gas is ignited, the flame transfers energy via convective heat transfer to the rods (23). When the rods (23) heat up, they radiate energy back towards the burner surface (17*b*) and also outwardly away from the burner surface (17*b*) so that radiation intensity and efficiency are optimized. A rod adjustment mechanism (84) may be disposed on the burner (10) for moving the rods (23) to thereby optimize radiation intensity and efficiency. Moreover, a temperature sensor may be disposed within a rod (23) for monitoring the temperature of the flame support rod structure (81). The temperature signal (82) can be used to control the position of the rods (23) via the rod adjustment mechanism (84) and/or a gas adjustment mechanism (88**) for manipulating the rate or contents of the combustible gas.

46 Claims, 7 Drawing Sheets

ADVANCED RADIANT GAS BURNER AND METHOD UTILIZING FLAME SUPPORT ROD STRUCTURE

The present invention generally relates to gas burners, and more particularly, to a radiant gas burner and method utilizing a flame support rod structure for efficiently generating high intensity radiant energy.

BACKGROUND OF THE INVENTION

The concept of radiant gas burners is well known in the art. A radiant gas burner converts chemical energy within a combustible gas, usually a gas mixture of either air or oxygen ($O_2$) and a combustible fuel, such as methane ($CH_4$), into radiant energy, which is a form of electromagnetic radiation.

There are many types of radiant gas burners in use today, but most of them contain the following basic structural components: a gas inlet for receiving the fuel, a combustion chamber wherein the fuel is ignited, and a radiation element for emitting radiant energy based upon heat transferred thereto by the combustion process. The designs of such burners and the materials used in their construction vary considerably, but the main objective is invariably to heat the radiation element to the highest possible temperature via convective heat transfer from the combustion process, while at the same time inhibiting deformation, cracking or, other physical damage to the burner structure.

In the recent past, porous ceramic layers have been used for constructing radiation elements in radiant gas burners. Generally, porous ceramic layers can be heated to much higher temperatures than those temperatures attainable with metal radiation elements, such as metal grids, without degradation or deformation in structure. In these types of radiant gas burners, fuel is passed through the porous ceramic layer and fuel combustion occurs adjacent to and sometimes partially within a surface of the porous ceramic layer. In addition to achieving higher radiation intensities, a porous ceramic layer has a multiplicity of combustion zones situated therein near the burner surface, which result in a high combustion efficiency. The porous ceramic layers may be heated to temperatures well above 1400° C. without significant degradation in structure. In fact, the bonded hollow sphere foam can be heated to at least 1700° C. during operation without decomposition. Burners with a metal radiation element can withstand temperatures only up to about 1200° C., due to oxidation of the burner structure.

The porous ceramic layers can be fabricated from any of a number of ceramic compositions, including mullite ($3Al_2O_3 \cdot 2SiO_2$), alumina ($Al_2O_3$), zirconia ($ZrO_2$), silicon carbide (SIC), and other materials. Moreover, the infrastructures of porous ceramic layers can vary. An example of one type of commercially available porous ceramic layer which can be used as a radiation element is "reticulated ceramic." This type of ceramic is characterized by numerous bonded struts and is described in detail in, for instance, U.S. Pat. Nos. 4,608,012 to Cooper and 3,912,443 to Ravault et al. Another example of a porous ceramic layer suitable for use as a radiation element is "bonded hollow sphere foam", or "hollow microsphere foam." This type of ceramic is characterized by a network of hollow ceramic spheres which are bonded together and the spheres are described in detail in, for instance, U.S. Pat. No. 4,671,909 to Torobin. Bonded hollow sphere foam is commercially available from and manufactured by Ceramic Fillers, Inc., Atlanta, Ga., U.S.A., and is sold under the trademark "Aerospheres™."

Although the use of porous ceramic layers as radiation elements in radiant gas burners has increased the intensity and efficiency at which chemical energy in fuel can be converted into radiant energy, the designs of radiant gas burners using porous ceramic layers remain in a state of infancy and their efficiencies are less than optimal. Accordingly, a need exists in the industry for new and improved radiant gas burners utilizing porous ceramic layers which exhibit higher efficiencies and higher radiation intensities than presently known burner designs.

SUMMARY OF THE INVENTION

An object of the present invention is to overcome the inadequacies and deficiencies of the prior art as discussed previously and as generally known in the industry.

Another object of the present invention is to provide a high intensity radiant gas burner and method using a porous ceramic layer.

Another object of the present invention is to provide a high efficiency radiant gas burner and method using a porous ceramic layer.

Another object of the present invention is to provide a radiant gas burner which is simple in design and inexpensive to manufacture.

Another object of the present invention is to provide a radiant gas burner with a flexible design to permit easy adjustment of the radiation intensity and/or efficiency.

Another object of the present invention is to provide a radiant gas burner which is durable in structure and permits operation over a wide range of temperatures without substantial degradation in structure.

Briefly described, the present invention is a high intensity and high efficiency radiant gas burner and method. The radiant gas burner has a housing with an inlet for receiving a combustible gas, a porous ceramic layer (e.g., bonded hollow sphere foam, reticulated ceramic, ceramic fiber board, ported ceramic tile, etc.) supported by the housing for receiving the combustible gas therethrough, and a plurality of elongated, ceramic, flame support rods supported by the housing adjacent to and spaced slightly from a burner surface of the porous ceramic layer. The combustible gas can be ignited over the burner surface so that both the porous ceramic layer and the ceramic rods radiate heat. The rods enhance the intensity and efficiency of the radiant gas burner by receiving energy via convective heat transfer from the combustible gas and by, in turn, radiating energy. The radiant energy from the rods substantially supplements that from the ceramic layer.

In addition to achieving all of the aforementioned objects, the present invention has numerous other advantages, a few of which are delineated hereafter.

An advantage of the present invention is that the ceramic flame support rods are free floating bodies and can expand and contract without breakage.

Another advantage of the present invention is that the ceramic flame support rods can be easily replaced and repaired. In particular, the rods can be replaced with rods having smaller or larger diameters, with rods comprised of different materials, and/or with rods having a different surface coating.

Another advantage of the present invention is that a horizontal and/or vertical adjustment mechanism can be disposed on the radiant gas burner for adjusting the horizontal and/or vertical disposition of the rods relative to the burner surface of the porous ceramic layer.

Another advantage of the present invention is that a spacing adjustment mechanism can be disposed on the radiant gas burner for manipulating the spacing between the rods, thereby varying the throughput and pressure of the combustible gas and flame intensity.

Another advantage of the present invention is that a rotation mechanism can be employed on the radiant gas burner for rotating rods having a noncircular cross-section (e.g., elliptical-shaped rods, square-shaped rods, etc.), to thereby vary the throughput of combustible gas, burner intensity, and radiation efficiency.

Another advantage of the present invention is that a temperature sensor can be disposed within a rod for monitoring the temperature of the rods. The temperature signal from the temperature sensor can be used by a control system for manipulating the position of the rods over the burner surface of the foam and/or the spacing between the rods and/or the rotation of the rods (when a noncircular cross-section is utilized). The temperature signal can also be utilized by a control system to manipulate the combustible gas in order to achieve higher efficiency. For example, the combustible fuel level, oxygen level, or total gas mixture level can be adjusted.

Another advantage of the present invention is that the rods may be disposed adjacent to a burner surface which can have various geometrical configurations, including planar, nonplanar, concave, convex, etc.

Another advantage of the present invention is that the radiant burner can be used for various industrial and domestic heating applications which require high radiant efficiency and intensity.

Another advantage of the present invention is that the radiant gas burner exhibits low NOx emissions.

Another advantage of the present invention is that the adjustable flame support rods allow for tuning of burner operation, for instance, for an extended range of turn-down ratio in order to meet the needs of a significant range of energy input applications.

Another advantage of the present invention is that, in addition to being able to establish a uniform temperature distribution and radiation pattern, the burner can be modified by manipulating the rods in order to establish a nonuniform temperature distribution and a nonuniform radiation pattern. Specifically, to this end, the gaps between adjacent rods can be varied and/or the distance between rods and the burner surface can be varied across the expanse of the burner surface.

Other objects, features, and advantages of the present invention will become apparent to one with skill in the art upon examination of the following drawings and detailed description. It is intended that all such additional objects, features, and advantages be included herein within the scope of the present invention, as delineated in the claims.

BRIEF DESCRIPTION OF THE DRAWINGS

The present invention can be better understood with reference to the following drawings. In the drawings, like reference numerals designate corresponding parts throughout the several views. Moreover, it should be noted that the drawings are not necessarily to scale, emphasis instead being placed upon clearly illustrating principles of the present invention.

DETAILED DESCRIPTION OF THE PREFERRED EMBODIMENTS

Figure 1:
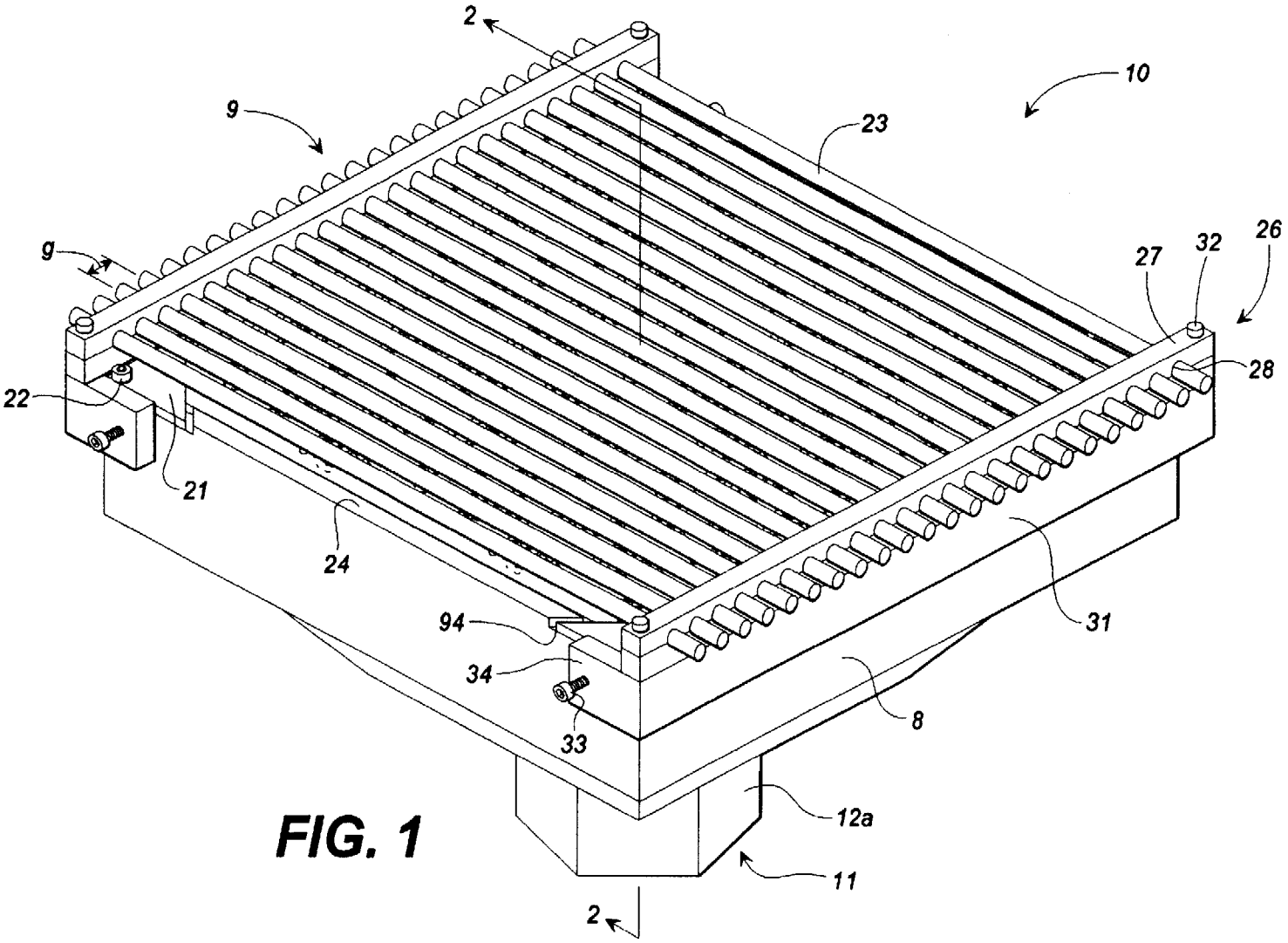
FIG. 1 is a front elevational perspective view of the high efficiency radiant gas burner in accordance with the present invention.
Figure 2:
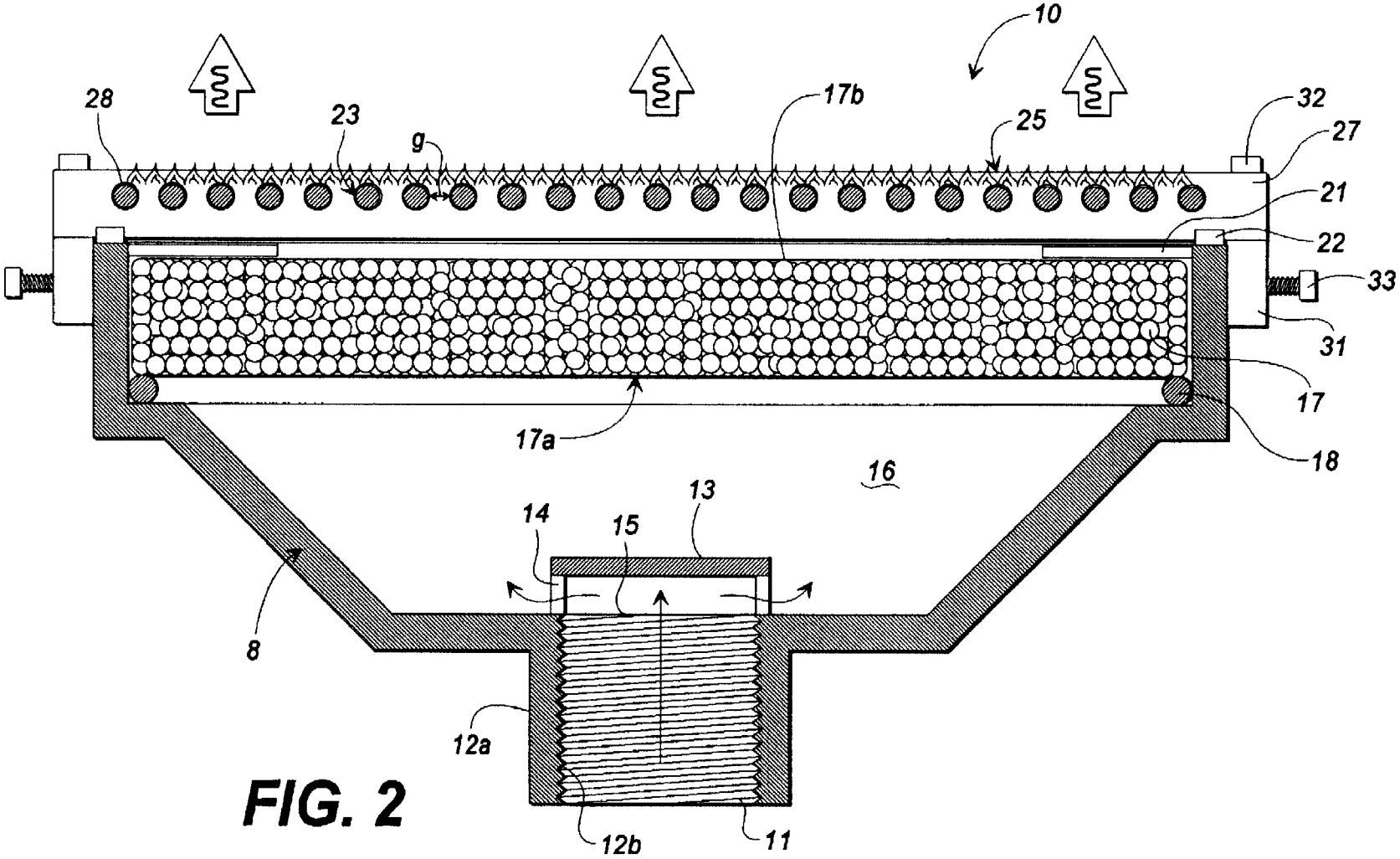
FIG. 2 is a cross-sectional view of the radiant gas burner of FIG. 1 taken along line 2—2.

FIGS. 1 and 2 illustrate a high intensity and high efficiency radiant gas burner 10 in accordance with the present invention. The radiant gas burner 10 comprises a durable rigid housing 8, preferably made of steel, metal, or any other suitable material. The preferred embodiment of the housing 8 has a four-sided pyramidal body, but many other geometrical configurations are possible, depending upon the attendant circumstances and requirements. The pyramidal body has a gas inlet 11 situated at the vertex end for receiving a combustible gas and a burner opening 9 at the opposing larger end for providing flame upon ignition of the gas. The combustible gas is any suitable gas fuel, but in the preferred embodiment, is a gas mixture of methane ($CH_4$) and air (containing oxygen $O_2$). The gas inlet 11 has an external octagonal circumference **12*a* for receiving a wrench and internal cylindrical pipe threads 12*b* for mating with a cylindrical threaded pipe (not shown) for feeding the combustible gas to the radiant gas burner 10. The combustible gas travels to the radiant gas burner 10 through the gas inlet 11 as indicated by the reference arrow in FIG. 2** at a pressure of approximately 0.02 to 0.50 inches of water ($H_2O$) in the preferred embodiment.

A gas injection plate 13 is disposed by a plurality of metal posts 14 in line with and over the interior orifice 15 of the gas inlet 11. The gas injection plate 13 serves as a barrier to the incoming combustible gas and causes spreading and distribution of the gas as indicated by the several reference arrows in FIG. 2.

A gas distribution chamber 16 receives and distributes the pressurized combustible gas across the expanse of a gas receiving surface 17*a* of a porous ceramic layer 17. The gas distribution chamber 16 increases in cross-section (along the pyramidal walls) from the interior orifice 15 of the gas inlet 11 toward the gas receiving surface 17*a* of the porous ceramic layer 17 so that the combustible gas is permitted to expand, the pressure of the combustible gas is reduced, and the speed thereof is reduced.

The porous ceramic layer 17 can be any conventional ceramic structure which is permeable to the combustible gas. In the preferred embodiment, the porous ceramic layer 17 is bonded hollow sphere foam, reticulated ceramic, ceramic fiber board, or ported ceramic tile, which are all commercially available materials. The thickness of the porous ceramic layer 17 can vary, depending upon the desired radiation characteristics and gas pressure, but in the preferred embodiment, the thickness of the porous ceramic layer 17 is approximately between ½" to 1¼". The porous ceramic layer 17 is secured within the housing 8 against a square-shaped annular seal 18 via triangular-shaped corner brackets 21, which are fastened to the housing 8 via threaded screws 22. The corner brackets 21 rest within a cavity 94, as shown in FIG. 1, so that the corner brackets 21 reside flush with the top edge 24 of the housing 8.

In accordance with a significant feature of the present invention, a plurality of elongated flame support rods 23 (solid or hollow) are spaced apart in parallel and are disposed over and spaced from a burner surface 17*b* of the porous ceramic layer 17. The rods 23 are preferably made from ceramic, for example, mullite ($3Al_2O_3 \cdot 2SiO_2$), alumina ($Al_2O_3$), zirconia ($ZrO_2$), SiC, etc. Moreover, the rods 23, in the preferred embodiment, are cylindrical and have an outside diameter of approximately ⅛". Moreover, the rods 23 are supported so that a gap g of approximately ⅛" exists between adjacent rods 23. The gap g is uniform across the expanse of the burner surface 17*b* in order to provide for a uniform radiation pattern from the radiant gas burner 10. When not ignited, the combustible gas passes through the gaps g between the rods 23. When the gas is ignited, combustion occurs adjacent to the rods 23, as indicated by combustion zone 25 in FIG. 2. The radiant gas burner 10 is sometimes referred to as a flameless burner because complete combustion occurs in or adjacent to the flame support layer, i.e., in and around the rods 23 and the flame is usually not visible directly.

The rods 23 can be fastened to or supported over the burner surface 17*b* of the burner 10 via any suitable apparatus. In the preferred embodiment, the rods 23 are supported by and fastened to the housing 8 via a pair of fastening mechanisms 26 which are disposed at the distal ends of the rods 23. Each fastening mechanism 26 has an upper, elongated, rod guide member 27 which has a plurality of apertures 28 for receiving therethrough the rods 23 respectively. The rod guide member 27 permits both longitudinal and radial expansion of the rods 23 when the rods 23 are heated and cooled. This feature of the present invention is significant in terms of durability and reuse of the radiant gas burner 10. A grid-like structure of ceramic serving as the flame support structure would undesirably fracture and/or warp.

The upper rod guide member 27 is secured to a lower elongated C-shaped attachment member 31 via screws 32, which extend through the rod guide member 27 and into a threaded aperture within the C-shaped elongated attachment member 31. In turn, the attachment member 31 is secured to the housing 8 via screws 33 which pass through the opposing sides 34 of the attachment member 31 and into a threaded aperture of the housing 8.

It is further envisioned that the rods could be connected to the burner 10 and disposed over the burner surface 17*b* via a pair of grid-like screens attached to the sides of the housing 8 and having square-like apertures for receiving and supporting the distal ends of the rods 23. With this configuration, the rods 23 can be moved horizontally and vertically by sliding the rods 23 in and out of the square-like apertures.

OPERATION

The operation of the radiant gas burner 10 will now be described. A combustible gas, which is pressurized at preferably 0.1–0.2 inch $H_2O$ is passed into the gas inlet 11. The combustible gas has fuel (methane for example) and oxygen components for a stoichiometric reaction, but the mixture can be adjusted so that it is rich in fuel or oxygen. The incoming combustible gas strikes the gas injection plate 13 and travels therearound into the gas distribution chamber 16, as indicated by arrows in FIG. 2. While in the gas distribution chamber 16, the combustible gas expands due to the increase in volume of the chamber 16. After the combustible gas expands, it passes into the porous ceramic layer 17. The gas diffuses through the porous ceramic layer 17 and is emitted from the burner surface 17*b* of the porous ceramic layer 17. Moreover, the gas passes through the gaps g between the rods 23, if not ignited. When the gas is ignited, combustion occurs adjacent to the rods 23, as indicated by combustion zone 25 in FIG. 2.

An understanding of the energy transfer is advisable for a complete understanding of the present invention. More specifically, chemical energy within the combustible gas is converted to heated gases when the mixture is ignited. These heated gases pass around the rods 23, thereby heating the rods 23 and transferring energy to the rods via convective heat transfer. In turn, the rods 23 radiate energy away from the radiant gas burner 10 and also back against the porous ceramic layer 17, thereby enhancing the overall radiation output of the radiant gas burner 10. In fact, the radiation from the combination of the flame support rods 23 and the porous ceramic layer 17 can be 30 to 40% efficient. Furthermore, the radiant gas burner 10 of the preferred embodiment has a range of operation approximately between 60,000 and 300,000 BTU/ft$^2$/hr; however, it is envisioned that higher intensity outputs are possible, depending upon the structural configuration.

ALTERNATIVE EMBODIMENTS

Figure 3B:
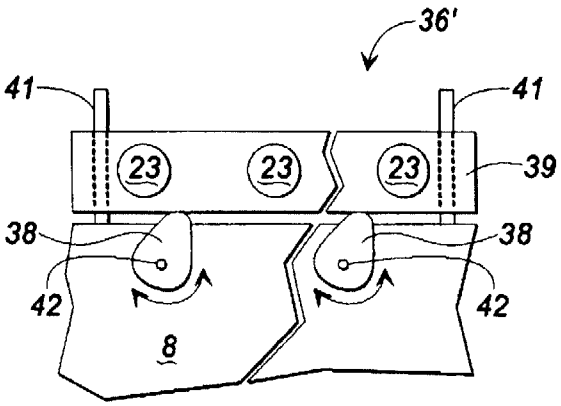
FIG. 3B is a side view of a specific example for implementing the vertical adjustment mechanism of FIG. 3A.
Figure 3D:
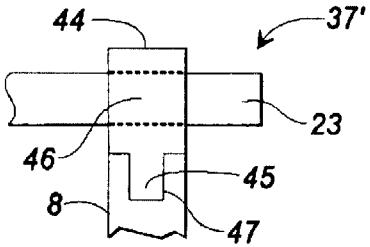
FIG. 3D is a cross-sectional view of the specific example of FIG. 3C taken along line 3C'—3C'.
Figure 3A:
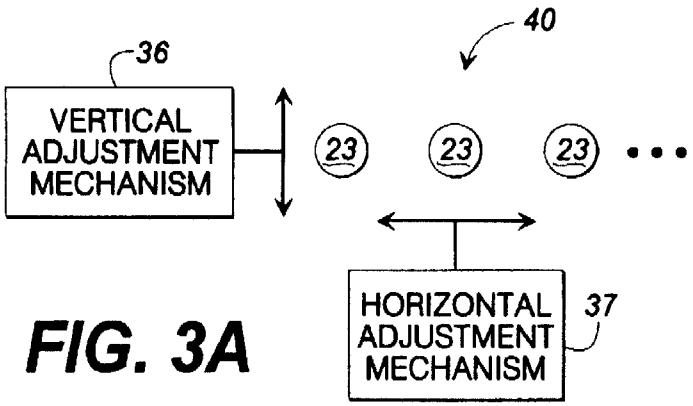
FIG. 3A is a schematic diagram showing a horizontal adjustment mechanism and a vertical adjustment mechanism for moving the position of the rods relative to the burner surface of the radiant gas burner of FIGS. 1 and 2.

As shown in FIG. 3A, the radiant gas burner 10 optionally may be equipped with a vertical adjustment mechanism 36 and/or a horizontal adjustment mechanism 37 for moving the rods 23 in a vertical and/or horizontal direction, respectively, relative to the elevational view of the radiant gas burner 10 in FIGS. 1 and 2. Movement of the rods 23, especially in the vertical direction, can optimize the intensity of the combustion zone 25 and the efficiency of the chemical-to-radiation conversion.

Many mechanical structures are well known in the art for constructing the vertical adjustment mechanism 36 and the horizontal adjustment mechanism 37. As an example, the vertical adjustment mechanism 36 as well as the horizontal adjustment mechanism 37 could be constructed by disposing a cam(s) on the housing 8 for driving a rod guide member which holds the rods 23.

FIG. 3B shows a vertical adjustment mechanism 36' having a pair of cams 38 for driving a rod guide member 39, which supports the rods 23, in an upward and downward direction relative to the housing 8. The rod guide member 39 is guided in the vertical direction via a pair of guide pins 41 which are mounted to the housing 8, which are situated at opposing ends of the rod guide member 39, and which move freely through respective apertures in the member 39. The cams 38 are rotated about respective axes 42, as indicated by directional arrows, via any conventional drive mechanism in order to move the rod guide member 39 in the vertical direction.

Figure 3C:
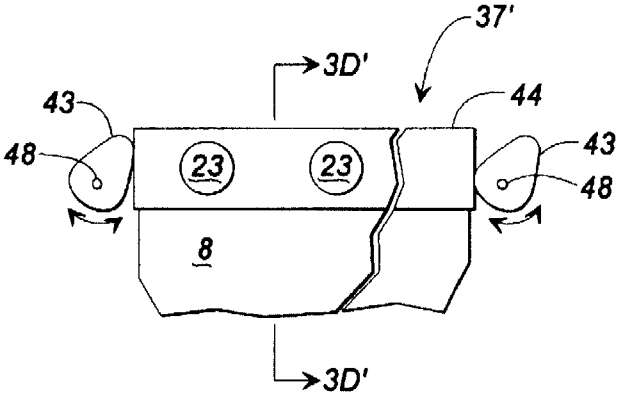
FIG. 3C is a side view of a specific example for implementing the vertical adjustment of FIG. 3A.

FIGS. 3C and 3D illustrate a horizontal adjustment mechanism 37'. The horizontal adjustment mechanism 37' has a pair of cams 43 disposed at opposing ends of a rod guide member 44, which supports the rods 23, for moving the rod guide member 44 in a horizontal direction. The cams 43 can be rotated about respective axes 48, as indicated by directional arrows, via any conventional drive mechanism. The rod guide member 44 has a downwardly extending square-shaped rail 45, as shown in FIG. 3D, which is narrower in width than the upper portion 46 of the rod guide member 44. Moreover, the rail 45 extends down into a square-shaped aperture 47 within the housing 8. The rail 45 slides horizontally within the aperture 47 to permit movement of the rods 23.

Figure 4A:
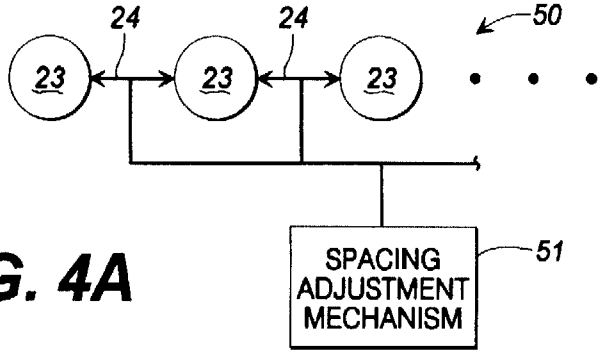
FIG. 4A is a schematic diagram showing a spacing adjustment mechanism for manipulating the spacing between the rods of the radiant gas burner of FIGS. 1 and 2.

As shown in FIG. 4A, a spacing adjustment mechanism 51 may be disposed on the radiant gas burner 10 for adjusting the gaps g between rods 23. The use of a spacing adjustment mechanism 51 is desirable for manipulating and optimizing the intensity of the combustion zone 25 and the efficiency of chemical-to-radiant energy conversion. Said another way, the manipulation of the gaps g causes manipulation of the throughway for the combustible gas through the flame support rod structure and the characteristics of the combustion zone 25.

Figure 4B:
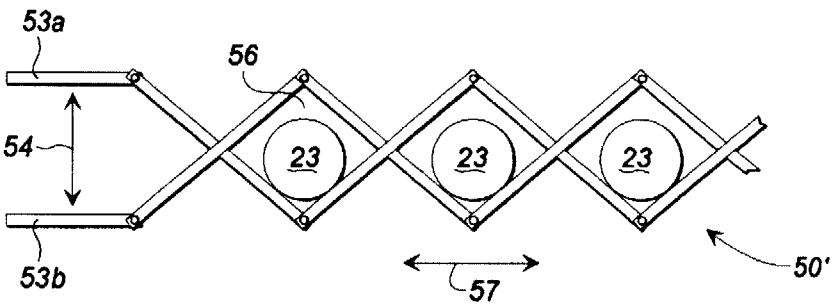
FIG. 4B is a side view of a specific example for implementing the spacing adjustment mechanism of FIG. 4A.

Many conventional mechanisms are known in the art for implementing the spacing adjustment mechanism 51 as shown in FIG. 4A. As a specific example, FIG. 45 illustrates a pantogram configuration 50' for adjusting the gaps g between the rods 23. The pantogram configuration 50' is disposed at both distal ends of the rods 23 and both opposing pantogram configurations 50' operate in concert to manipulate the gaps g while maintaining the rods in parallel. As shown in FIG. 4B, the pantogram configuration 50' has parallel spaced drive members **53*a*, 53*b*, which when moved as indicated by reference arrow 54, cause movement of rod holders 56 in the direction as indicated by reference arrow 57. The drive members 53*a*, 53*b*** can be driven, for example, by a rotatable threaded rod driven by a conventional motor.

Figure 4C:
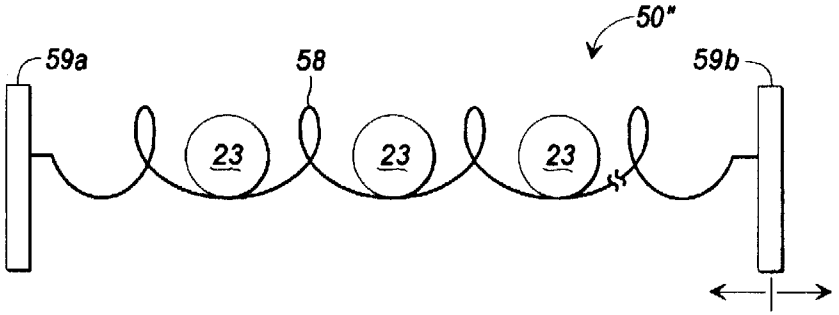
FIG. 4C is a side view of another specific example for implementing the spacing adjustment mechanism of FIG. 4A.

As another specific example, FIG. 4C shows a spring configuration 50" for adjusting the gaps g between the rods 23. The spring configuration 50" is disposed at both distal ends of the rods 23 and both opposing spring configurations 50" operate in concert to manipulate the gaps g while maintaining the rods 23 in parallel. At each spring configuration 50", as shown in FIG. 4C, the rods 23 reside upon the valley regions of an expandable/retractable spring 58, which is mounted at one end to a rigid member **59*a* and at the other end to a rigid member 59*b*. By moving one or both of the rigid members 59*a*, 59*b*, the gaps g between the rods 23 can be changed. By way of example, FIG. 4C shows movement of member 59*b*, while maintaining member 59*a*** stationary, in order to implement the spacing adjustment mechanism.

Figure 5B:
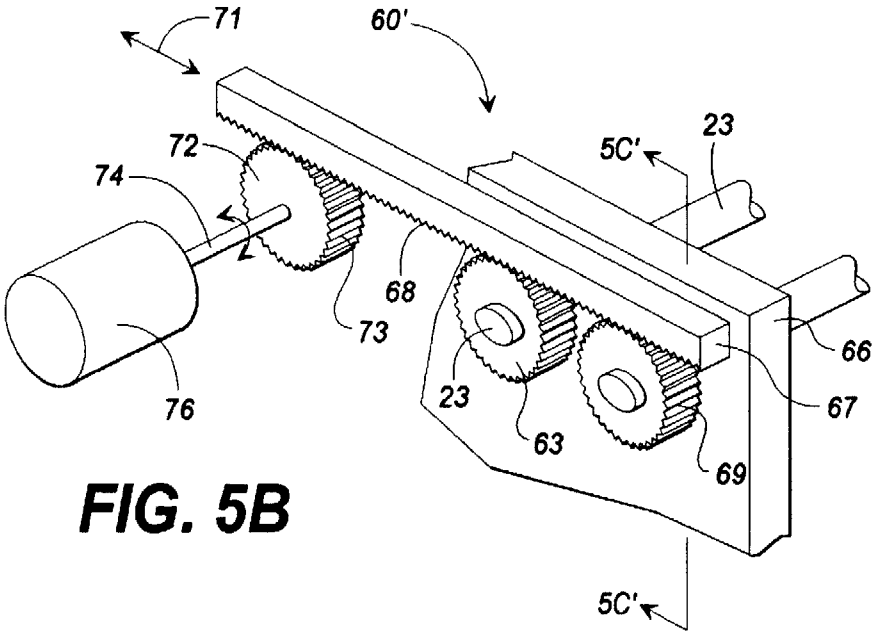
FIG. 5B is a front elevational perspective view of a specific example for implementing the rotation mechanism of FIG. 5A.
Figure 5D:
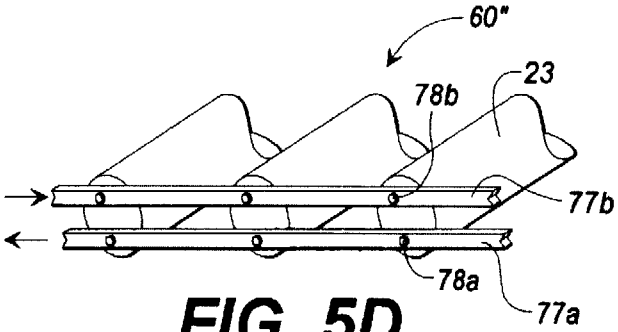
FIG. 5D is a front elevational perspective view of another specific example for implementing the rotation mechanism of FIG. 5A.
Figure 5A:
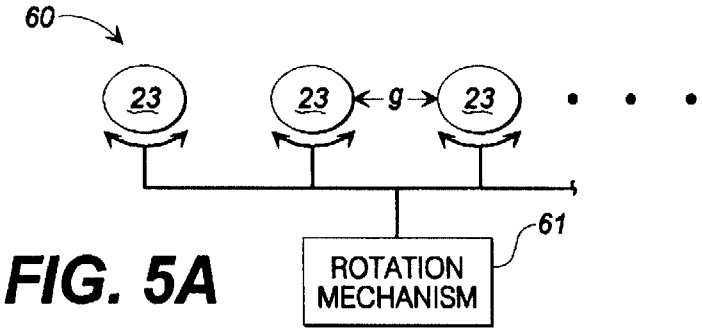
FIG. 5A is a schematic diagram showing rods with noncircular cross-sections (i.e., elliptical) and a rotation mechanism for rotating the noncircular rods.

As illustrated in FIG. 5A, the radiant gas burner 10 may be equipped with a rotation mechanism 61 for rotating the rods 23 about their respective axes. In this alternative embodiment, the rods 23 have a noncircular cross-section for permitting adjustment of the gap g between adjacent rods 23 via rotation of the rods 23. In the preferred embodiment, the rods 23 have an elliptical cross-sectional area and the rods 23 are rotated in unison in the same rotational direction to thereby vary the gap g. The rotation mechanism 61 in combination with the rods 23 having a noncircular cross-section, when operated as described, can be used to manipulate and optimize the intensity of the combustion zone 25 and the efficiency of the chemical-to-radiant energy conversion by varying the throughway for the combustible gas and the characteristic of the combustion zone 25.

Figure 5C:
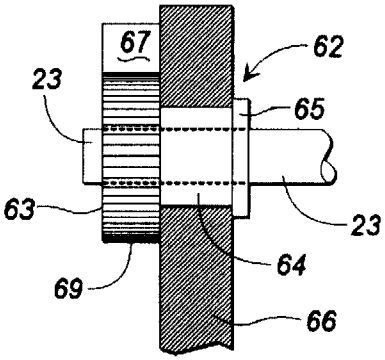
FIG. 5C is an exploded partial cross-sectional view of the specific example of FIG. 5B taken along line 5C'—5C'.

By way of example, FIGS. 5B and 5C show a possible specific implementation of the rotation mechanism 61 (FIG. 5A). In essence, FIGS. 5B and 5C illustrate a rack and pinion arrangement 60'. As shown in FIGS. 5B and 5C, each rod 23 has a distal end passing through a driven rotatable bearing 62 having an elliptical aperture for receiving and mating with the distal end of the rod 23. The other distal end of each rod 23 can be freely rotatable within an appropriately large circular aperture or can be disposed within a corresponding elliptical aperture of an undriven bearing which is similar in structure to the bearing 62, so that each rod 23 can be rotated via driving force against the bearing 62.

As shown in FIG. 5C, each bearing 62 has an outer gear 63, an inner circular smooth portion 64, and a circular retaining lip 65 for securing the bearing 62 to a rigid bracket 66, while permitting rotation of the bearing 62 therein. With the foregoing configuration, rotation of the gears 63 forces rotation of the rods 23.

The gears 63 are engaged by and rotated by an elongated bar 67 having gear threads 68 situated on its underside for mating with the gear threads 69 of the gears 63. The bar 67 is moved longitudinally as indicated by the bidirectional reference arrow 71 in FIG. 5B.

The bar 67 is moved longitudinally by a circular motor drive gear 72 having threads 73 for engaging the bar gear threads 68. The motor drive gear 72 is rotated by motor shaft 74, which is driven by any suitable motor 76.

FIG. 5D shows another possible specific implementation of the rotation mechanism 61 (FIG. 5A). FIG. 5D shows a dual moveable bar configuration 60" wherein elongated parallel bars **77*a*, 77*b* are connected to an end of the rods 23 via respective pins 78*a*, 78*b*, and the bars 77*a*, 77*b* are moved in opposing directions as indicated by the reference arrow in FIG. 5D in order to effectuate rotation of the rods 23. The other distal end (not shown) of the rods 23 is permitted to rotate freely within the confines of an aperture or is moved via a pair of bars in concert with the bars 77*a*, 77*b*. Furthermore, one of the bars 77*a*, 77*b* could be maintained stationary relative to the burner housing 8, while the other is moved appropriately, in order to accomplish the desired rotation of the rods 23**.

It should be emphasized that the rack and pinion arrangement of FIGS. 5B and 5C and the dual movable bar configuration of FIG. 5D are merely examples of specific implementations for the rotation mechanism 61 (FIG. 5A) and that numerous other possible mechanical configurations are known in the art.

Figure 6:
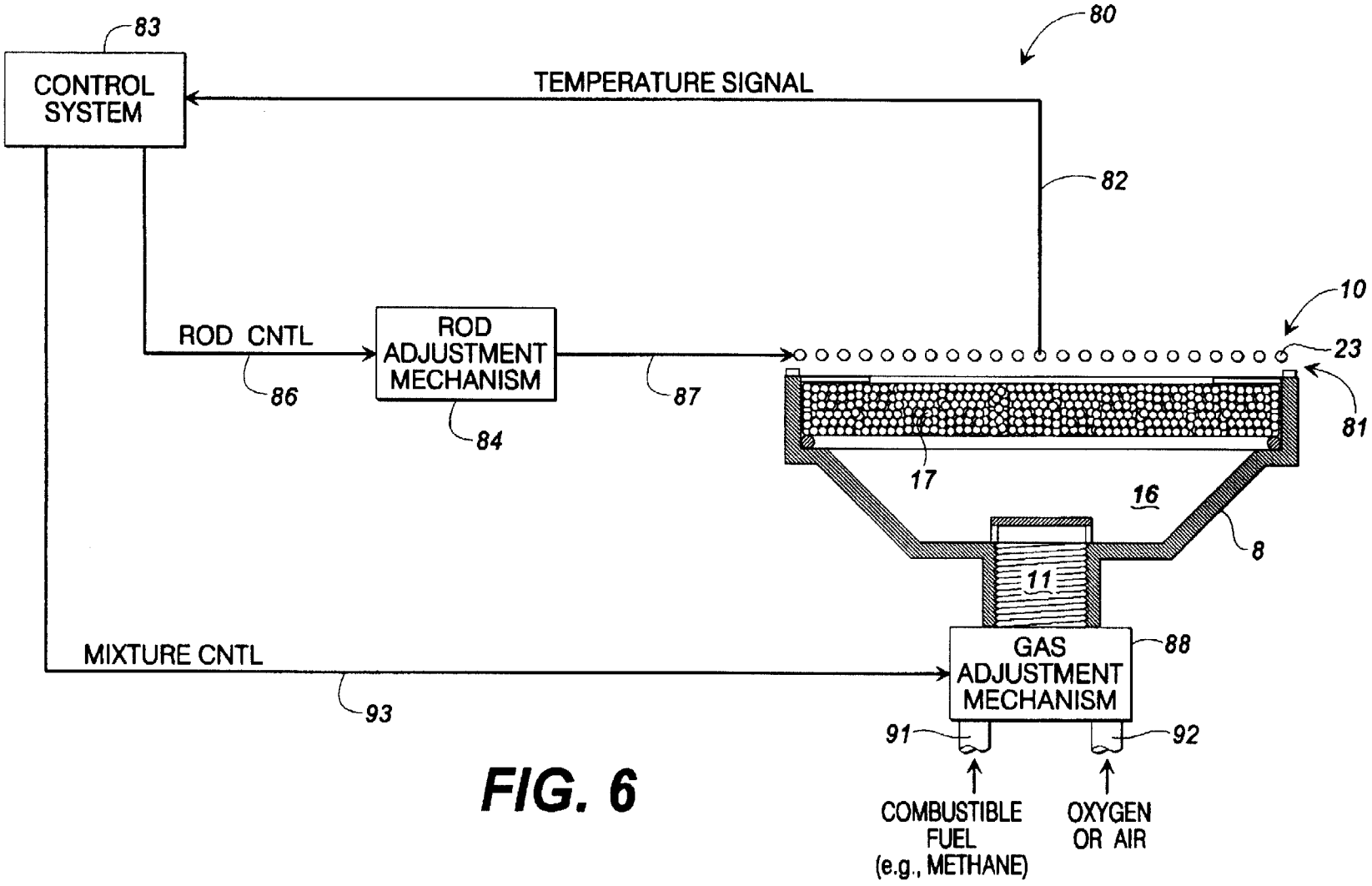
FIG. 6 is a schematic diagram illustrating a feedback control loop for dynamically and continuously controlling the position of the rods over the burner surface based upon the temperature sensed within a rod.

FIG. 6 illustrates a feedback control system 80 for controlling the position of the rods 23 relative to the burner surface **17*b* and/or the rate or content of the incoming combustible gas based upon temperature sensed at the flame support rod structure 81. The feedback control system 83 can be utilized to dynamically and continuously optimize the intensity and efficiency of the radiant gas burner 10** while in operation.

As shown in FIG. 6, the temperature at the flame support rod structure 81 is measured and a temperature signal 82 is generated as a function thereof. The temperature signal 82 may be generated by any suitable temperature sensor, or thermocouple, disposed within a flame support rod 23. A hollow rod 23 may be utilized and a conventional thermocouple may be disposed therein with electrical connections passing out of the distal end(s).

A control system 83 receives the temperature signal 82, determines whether the rods 23 should be moved, and determines whether the pressure and/or contents of the combustible gas should be modified. The control system 83 may be constructed from any suitable logic and may be implemented by hardware and/or software.

A rod adjustment mechanism 84 manipulates the position of the rods 23 under the control of the control system 83, as indicated by rod control signal 86. The rod adjustment mechanism 84 may include a vertical adjustment mechanism 36 (FIG. 3), a horizontal adjustment mechanism 37 (FIG. 3), a spacing adjustment mechanism 51 (FIG. 4A), and/or a rotation mechanism 61 (FIG. 5A).

A gas adjustment mechanism 88 is connected to the gas inlet 11 and regulates the flow and content of the combustible gas flowing to the inlet 11. As shown, the gas adjustment mechanism 88 receives the combustible fuel 91 and oxygen 92 (or air). Moreover, the gas adjustment mechanism 88 can control the flow rate of the gas mixture (fuel and oxygen), the flow rate of either component, or the ratio of the components, based upon a mixture control signal 93 received from the control system 83.

Figure 7B:
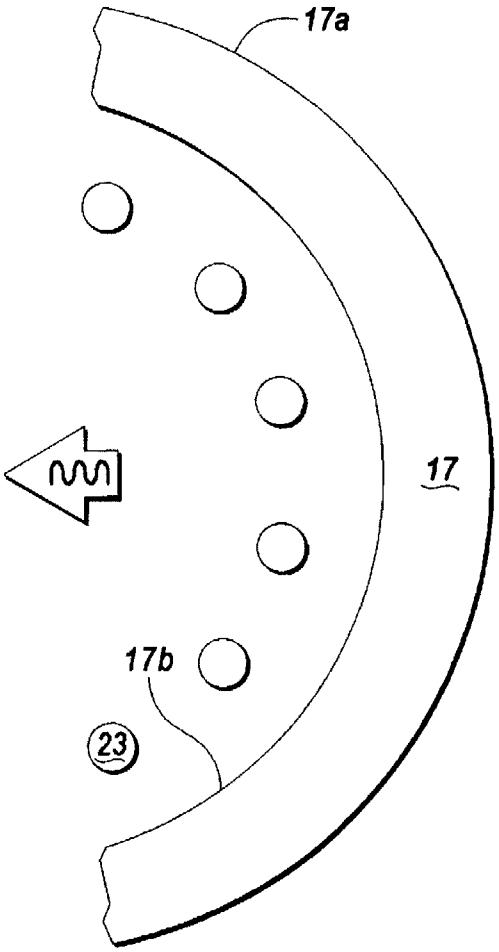
FIG. 7B is a partial cross-sectional view of an alternative embodiment of the radiant gas burner of FIGS. 1 and 2 having a nonplanar, concave, burner surface with an associated nonplanar, concave, flame support rod structure.
Figure 7A:
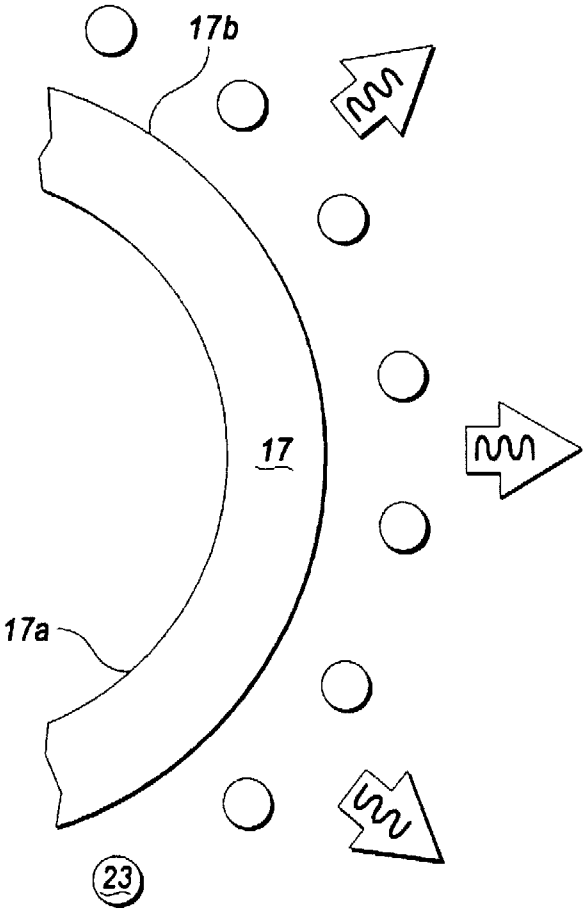
FIG. 7A is a partial cross-sectional view of an alternative embodiment of the radiant gas burner of FIGS. 1 and 2 having a nonplanar, convex, burner surface with an associated nonplanar, convex, flame support rod structure.

As shown in FIGS. 7A and 7B, the rods 23 may also be disposed about a nonplanar burner surface **17*b* for optimizing the radiation efficiency thereof. FIG. 7A shows placement of the rods 23 spaced from and parallel to a convex porous ceramic layer 17 with a convex burner surface 17*b*. With this configuration, radiant energy is emitted radially (normal to the burner surface 17*b*), as indicated by reference arrows in FIG. 7A, by the combination of the burner surface 17*b* and by the rods 23**. A potential application for the embodiment of FIG. 7A might be a cylindrical burner situated within a conventional water heater.

As shown in FIG. 7B, the porous ceramic layer 17 and burner surface **17*b* may be configured concavely in parallel. With this configuration, the rods 23 are disposed in a concave configuration and spaced from the burner surface 17*b***. In operation, radiant energy is focused inwardly towards a focal point and then emitted with high intensity outwardly, as indicated by the reference arrow in FIG. 7B.

Thus far, the discussion has focused on establishing a uniform temperature distribution and uniform radiation pattern above the burner surface **17*b*. However, it is envisioned that a nonuniform temperature distribution and/or radiation pattern could be established by the radiant gas burner 10 over the burner surface 17*b* by varying the gap g (FIG. 2) between the rods 23 and/or by varying the distance d (FIG. 2) between the rods 23 and the burner surface 17*b*. As an example of implementation, this functionality could be accomplished by applying one or more of the following mechanisms to only a portion of the rods 23, while maintaining the remaining portion as stationary: the horizontal adjustment mechanism 37 (FIG. 3), the vertical adjustment mechanism 36 (FIG. 3), the spacing adjustment mechanism 51 (FIG. 4A), and the rotation mechanism 61 (FIG. 5A) with noncircular cross-section rods 23**.

It will be obvious to those skilled in the art that many variations and modifications may be made to the preferred embodiments, as described above, without departing substantially from the spirit and scope of the present invention. All such variations and modifications are intended to be included herein within the scope of the present invention, as delineated in the following claims.

Wherefore, the following is claimed:

1. A radiant gas burner, comprising:

a porous ceramic layer having a gas receiving surface and a burner surface;

a housing supporting said porous ceramic layer, said housing having an inlet for receiving a combustible gas and configured to direct said combustible gas through said porous ceramic layer; and a plurality of elongated ceramic rods supported by said housing adjacent to and spaced from said burner surface of said porous ceramic layer;

whereby said combustible gas can be ignited over said burner surface so that both said porous ceramic layer and said ceramic rods radiate energy.

2. The radiant burner of claim 1, wherein said porous ceramic layer is reticulated ceramic.

3. The radiant burner of claim 1, wherein said porous ceramic layer is bonded hollow sphere foam.

4. The radiant burner of claim 1, wherein said porous ceramic layer is ceramic fiber board.

5. The radiant burner of claim 1, wherein said porous ceramic layer is ported ceramic tile.

6. The radiant burner of claim 1, wherein said housing and said porous ceramic layer are adapted to permit a range of operation approximately between 60,000 and 300,000 BTU/$ft^2$/hr.

7. The radiant burner of claim 1, wherein at least one of said rods is hollow for receiving a temperature sensor.

8. The radiant burner of claim 1, wherein at least one of said rods has an elliptical cross-section.

9. The radiant burner of claim 1, wherein said burner surface is generally nonplanar and said rods are disposed adjacent to said burner surface in an arrangement which is generally parallel to a contour associated with said burner surface.

10. The radiant burner of claim 1, wherein said burner surface is generally planar and said rods are arranged in a generally planar configuration.

11. The radiant burner of claim 1, further comprising a means for moving said rods in a direction toward and away from said burner surface.

12. The radiant burner of claim 1, further comprising a means for moving said rods so that spacing between said rods is varied while maintaining said rods parallel to said burner surface.

13. The radiant burner of claim 1, further comprising:

a temperature sensor situated within one of said rods;

rod adjustment means for moving said rods relative to said burner surface; and control means for receiving a signal from said sensor and for controlling said rod adjustment means based upon said signal so that rod temperature is controlled.

14. The radiant burner of claim 1, further comprising:

a temperature sensor situated within one of said rods;

gas adjustment means for controlling a flow of said gas into said inlet of said housing; and control means for receiving a signal from said sensor and for controlling said gas adjustment means based upon said signal so that flame temperature is controlled.

15. The radiant gas burner of claim 1, wherein said frame allows said rods to thermally expand along at least one degree of freedom.

16. A method for radiating heat, comprising the steps of:

passing a combustible gas toward a gas receiving surface of a porous ceramic layer, through said ceramic layer, and out from a burner surface of said ceramic layer;

disposing a plurality of elongated ceramic rods adjacent to and spaced from said burner surface;

permitting combustion of said combustible gas at a location adjacent said burner surface; and radiating heat from said burner surface and said rods.

17. The method of claim 16, further comprising the step of moving said rods in order to adjust an aperture therebetween and said location of said combustion.

18. The method of claim 17, wherein said burner comprises a frame for supporting said rods, and further comprising the step of allowing said ceramic rods to thermally expand within at least one degree of freedom with respect to said frame.

19. The method of claim 16, wherein said rods are noncircular in cross-section and further comprising the step of rotating said rods in order to adjust an aperture therebetween and said location of said combustion.

20. The method of claim 16, further comprising the steps of:

measuring temperature inside one of said rods; and controlling a size of a throughway through said rods based upon said temperature.

21. The method of claim 16, further comprising the step of creating a nonuniform radiation pattern by varying a gap between adjacent rods across said burner surface.

22. The method of claim 16, further comprising the step of creating a nonuniform radiation pattern by varying a distance between said adjacent rods and said burner surface.

23. A radiant gas burner, comprising:

a porous ceramic layer having a gas receiving surface and a burner surface;

a housing supporting said porous ceramic layer, said housing having an inlet for receiving a combustible gas and configured to direct said combustible gas through said porous ceramic layer; and a plurality of elongated ceramic rods supported by said housing adjacent to and spaced from said burner surface of said porous ceramic layer wherein at least one of said rods is hollow for receiving a temperature sensor;

whereby said combustible gas can be ignited over said burner surface so that both said porous ceramic layer and said ceramic rods radiate energy.

24. The radiant burner of claim 23, wherein said burner surface is generally planar and said rods are arranged in a generally planar configuration.

25. The radiant burner of claim 23, further comprising a means for moving said rods so that the spacing between said rods is varied while maintaining said rods parallel to said burner surface.

26. A radiant gas burner, comprising:

a porous ceramic layer having a gas receiving surface and a burner surface;

a housing supporting said porous ceramic layer, said housing having an inlet for receiving a combustible gas and configured to direct said combustible gas through said porous ceramic layer; and a plurality of elongated ceramic rods supported by said housing adjacent to and spaced from said burner surface of said porous ceramic layer;

wherein said burner surface is generally nonplanar and said rods are disposed adjacent to said burner surface in an arrangement which is generally parallel to a contour associated with said burner surface;

whereby said combustible gas can be ignited over said burner surface so that both said porous ceramic layer and said ceramic rods radiate energy.

27. The radiant burner of claim 26, wherein said burner surface is generally planar and said rods are arranged in a generally planar configuration.

28. The radiant burner of claim 26, further comprising a means for moving said rods so that the spacing between said rods is varied while maintaining said rods parallel to said burner surface.

29. The radiant burner of claim 26, wherein at least one of said rods is hollow for receiving a temperature sensor.

30. A radiant gas burner, comprising:

a porous ceramic layer having a gas receiving surface and a burner surface;

a housing supporting said porous ceramic layer, said housing having an inlet for receiving a combustible gas and configured to direct said combustible gas through said porous ceramic layer;

a plurality of elongated ceramic rods supported by said housing adjacent to and spaced from said burner surface of said porous ceramic layer; and a means for moving said rods so that the spacing between said rods is varied while maintaining said rods parallel to said burner surface;

whereby said combustible gas can be ignited over said burner surface so that both said porous ceramic layer and said ceramic rods radiate energy.

31. The radiant burner of claim 30, wherein said burner surface is generally planar and said rods are arranged in a generally planar configuration.

32. The radiant burner of claim 30, wherein at least one of said rods is hollow for receiving a temperature sensor.

33. A radiant gas burner, comprising:

a porous ceramic layer having a gas receiving surface and a burner surface;

a housing supporting said porous ceramic layer, said housing having an inlet for receiving a combustible gas and configured to direct said combustible gas through said porous ceramic layer;

a plurality of elongated ceramic rods supported by said housing adjacent to and spaced from said burner surface of said porous ceramic layer;

a temperature sensor situated within one of said rods;

rod adjustment means for moving said rods relative to said burner surface; and control means for receiving a signal from said sensor and for controlling said rod adjustment means based upon said signal so that rod temperature is controlled;

whereby said combustible gas can be ignited over said burner surface so that both said porous ceramic layer and said ceramic rods radiate energy.

34. A radiant gas burner, comprising:

a porous ceramic layer having a gas receiving surface and a burner surface;

a housing supporting said porous ceramic layer, said housing having an inlet for receiving a combustible gas and configured to direct said combustible gas through said porous ceramic layer;

a plurality of elongated ceramic rods supported by said housing adjacent to and spaced from said burner surface of said porous ceramic layer;

a temperature sensor situated within one of said rods; gas adjustment means for controlling a flow of said gas into said inlet of said housing; and control means for receiving a signal from said sensor and for controlling said gas adjustment means based upon said signal so that flame temperature is controlled;

whereby said combustible gas can be ignited over said burner surface so that both said porous ceramic layer and said ceramic rods radiate energy.

35. A method for radiating heat, comprising the steps of:

passing a combustible gas toward a gas receiving surface of a porous ceramic layer, through said ceramic layer, and out from a burner surface of said ceramic layer;

disposing a plurality of elongated ceramic rods adjacent to and spaced from said burner surface, wherein said rods are noncircular in cross-section;

permitting combustion of said combustible gas at a location adjacent said burner surface;

radiating heat from said burner surface and said rods; and rotating said rods in order to adjust an aperture therebetween and said location of said combustion.

36. The method of claim 35, further comprising the steps of:

measuring temperature inside one of said rods; and controlling a size of a throughway said rods based upon said temperature.

37. The method of claim 35, further comprising the step of creating a nonuniform radiation pattern by varying a gap between adjacent rods across said burner surface.

38. The method of claim 35, further comprising the step of creating a nonuniform radiation pattern by varying a distance between said adjacent rods and said burner surface.

39. A method for radiating heat, comprising the steps of:

passing a combustible gas toward a gas receiving surface of a porous ceramic layer, through said ceramic layer, and out from a burner surface of said ceramic layer;

disposing a plurality of elongated ceramic rods adjacent to and spaced from said burner surface;

permitting combustion of said combustible gas at a location adjacent said burner surface;

radiating heat from said burner surface and said rods;

measuring temperature inside one of said rods; and controlling a size of a throughway said rods based upon said temperature.

40. The method of claim 39, further comprising the step of creating a nonuniform radiation pattern by varying a gap between adjacent rods across said burner surface.

41. The method of claim 39, further comprising the step of creating a nonuniform radiation pattern by varying a distance between said adjacent rods and said burner surface.

42. A method for radiating heat, comprising the steps of:

passing a combustible gas toward a gas receiving surface of a porous ceramic layer, through said ceramic layer, and out from a burner surface of said ceramic layer;

disposing a plurality of elongated ceramic rods adjacent to and spaced from said burner surface;

permitting combustion of said combustible gas at a location adjacent said burner surface;

radiating heat from said burner surface and said rods; and creating a nonuniform radiation pattern by varying a gap between adjacent rods across said burner surface.

43. The method of claim 42, further comprising the step of creating a nonuniform radiation pattern by varying a distance between said adjacent rods and said burner surface.

44. A method for radiating heat, comprising the steps of:

passing a combustible gas toward a gas receiving surface of a porous ceramic layer, through said ceramic layer, and out from a burner surface of said ceramic layer;

disposing a plurality of elongated ceramic rods adjacent to and spaced from said burner surface;

permitting combustion of said combustible gas at a location adjacent said burner surface;

radiating heat from said burner surface and said rods; and creating a nonuniform radiation pattern by varying a distance between said adjacent rods and said burner surface.

45. A method for radiating heat, comprising the steps of:

passing a combustible gas toward a gas receiving surface of a porous ceramic layer, through said ceramic layer, and out from a burner surface of said ceramic layer;

disposing a plurality of elongated ceramic rods adjacent to and spaced from said burner surface;

permitting combustion of said combustible gas at a location adjacent said burner surface;

radiating heat from said burner surface and said rods; and moving said rods in order to adjust an aperture therebetween and said location of said combustion.

46. A radiant gas burner, comprising:

a porous ceramic layer having a gas receiving surface and a burner surface;

a housing supporting said porous ceramic layer, said housing having an inlet for receiving a combustible gas and configured to direct said combustible gas through said porous ceramic layer;

a plurality of elongated ceramic rods supported by said housing adjacent to and spaced from said burner surface of said porous ceramic layer; and means for moving said rods in a direction toward and away from said burner surface;

whereby said combustible gas can be ignited over said burner surface so that both said porous ceramic layer and said ceramic rods radiate energy.

* * * * *

UNITED STATES PATENT AND TRADEMARK OFFICE

CERTIFICATE OF CORRECTION

PATENT NO. : 5,641,282

DATED : June 24, 1997

INVENTOR(S) : Lee et al.

It is certified that error appears in the above-indentified patent and that said Letters Patent is hereby corrected as shown below:

In column 1, line 28, after "cracking or", delete the comma.

In column 1, line 52, delete "SIC" and replace with "SiC".

In claim 36, column 13, line 41, add "between" after "throughway".

In claim 39, column 13, line 60, add "between" after "throughway".

Signed and Sealed this

Ninth Day of September, 1997

*Attest:*

Bruce Lehman

BRUCE LEHMAN

*Attesting Officer*

*Commissioner of Patents and Trademarks*